US005451491A

United States Patent [19]

Szajewski et al.

[11] Patent Number: 5,451,491

[45] Date of Patent: Sep. 19, 1995

[54] METHOD OF BLEACHING AND FIXING A COLOR PHOTOGRAPHIC ELEMENT USING A PERACID BLEACH AND A LOW AMMONIUM FIXER

[75] Inventors: Richard P. Szajewski; John M. Buchanan, both of Rochester, N.Y.

[73] Assignee: Eastman Kodak Company, Rochester, N.Y.

[21] Appl. No.: 198,426

[22] Filed: Feb. 22, 1994

Related U.S. Application Data

[63] Continuation-in-part of Ser. No. 998,155, Dec. 29, 1992, abandoned.

[51] Int. Cl.[6] ..... G03C 7/92

[52] U.S. Cl. ..... 430/393; 430/428; 430/429; 430/430; 430/455; 430/460; 430/461; 430/943

[58] Field of Search ..... 430/393, 428, 429, 430, 430/455, 460, 461, 943

[56] References Cited

U.S. PATENT DOCUMENTS

| | | | |
|---|---|---|---|
| 4,277,556 | 7/1981 | Koboshi et al. | 430/393 |
| 4,328,306 | 5/1982 | Idota et al. | 430/430 |
| 4,448,878 | 5/1984 | Yamamuro et al. | 430/507 |
| 4,458,010 | 7/1984 | Yamamuro et al. | 430/393 |
| 4,481,290 | 11/1984 | Kishimoto et al. | 430/543 |
| 4,506,007 | 3/1985 | Nakajima et al. | 430/393 |
| 4,508,816 | 4/1985 | Yamamuro jet al. | 430/393 |
| 5,183,727 | 2/1993 | Schmittou et al. | 430/372 |
| 5,318,880 | 6/1994 | English et al. | 430/393 |

FOREIGN PATENT DOCUMENTS

| | | | |
|---|---|---|---|
| 428101 | 5/1991 | European Pat. Off. . | |
| 3919551 | 12/1990 | Germany . | |
| 92-07300 | 4/1992 | WIPO | 430/430 |

OTHER PUBLICATIONS

"Kodak Persulfate Bleach For Process ECN-2", Society of Motion Picture & Television Engineers Journal, vol. 91, p. 1058, (Nov., 1982).

"Abridged Specifications For Process RVNP Using Kodak Packaged Chemicals", Eastman Kodak Company Publication H-12, (1979).

"Abridged Specifications For Process ECN-2", Eastman Kodak Company Publication H-36, (1984).

"The Theory of the Photographic Process", T. H. James, ed., 4th ed., Macmillan, New York, 1977, pp. 442–443, 447–450.

*Primary Examiner*—Charles L. Bowers, Jr.
*Assistant Examiner*—J. Pasterczyk
*Attorney, Agent, or Firm*—J. Lanny Tucker; Sarah Meeks Roberts

[57] ABSTRACT

A method of desilvering an imagewise and developed color silver halide element, said method comprising bleaching the photographic element with a peracid bleach and subsequently contacting the photographic element with a fixer solution comprising thiosulfate anion and sodium cation;

wherein the Molar-minute fixing Time is less than about 0.2 Molar-minutes $\times m^2/g$ Ag $\times$ the grams of incorporated silver per square meter of the photographic element.

23 Claims, 1 Drawing Sheet

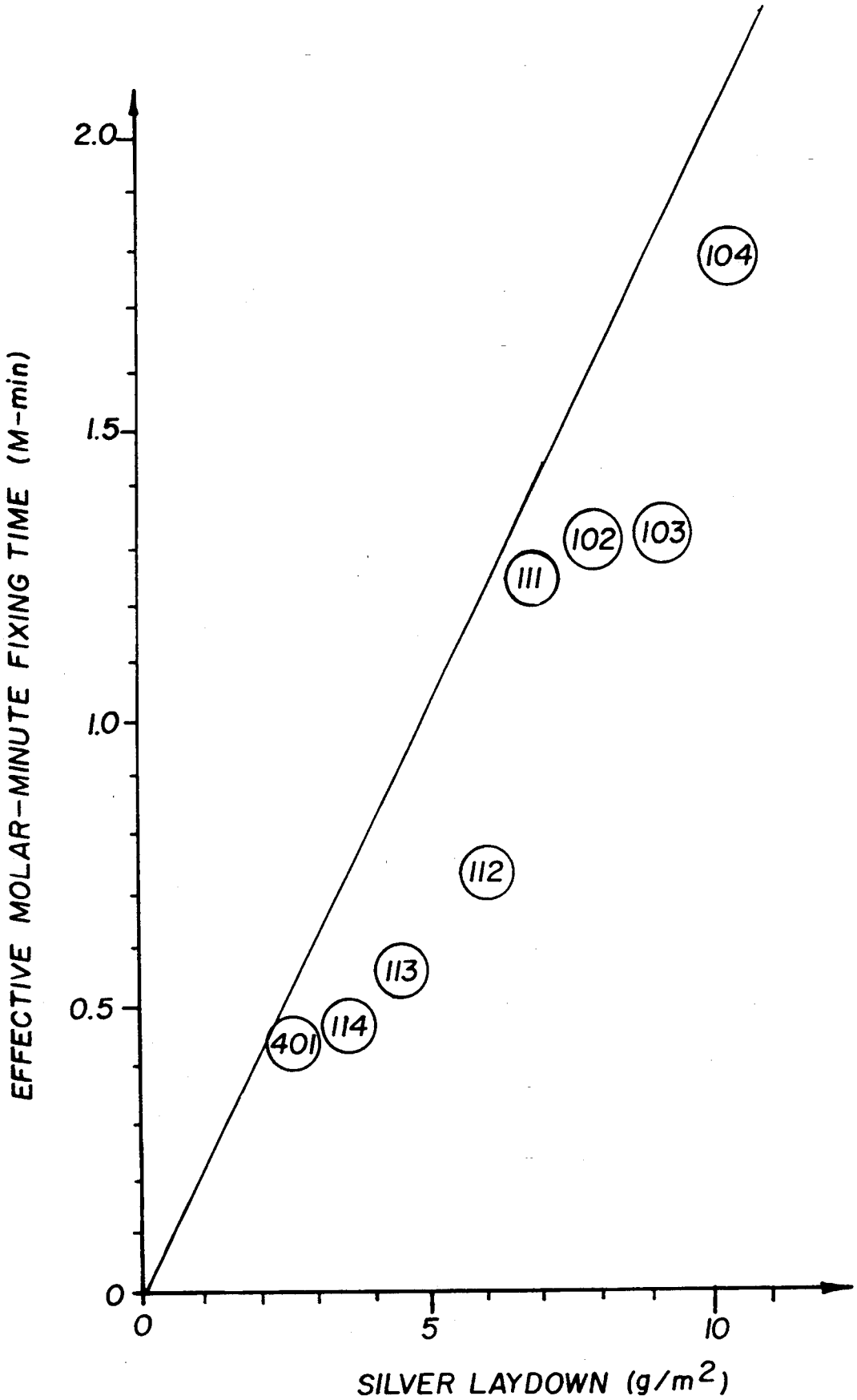
EFFECTIVE MOLAR-MINUTE FIXING TIME (M-min)
2.0
1.5
1.0
0.5
0
104
102
103
111
112
113
114
401
0
5
10
SILVER LAYDOWN (g/m2)

METHOD OF BLEACHING AND FIXING A COLOR PHOTOGRAPHIC ELEMENT USING A PERACID BLEACH AND A LOW AMMONIUM FIXER

CROSS-REFERENCE TO RELATED APPLICATIONS

This is a continuation-in-part of application Ser. No. 07/998,155, filed Dec. 29, 1992, now abandoned. This invention is also related to co-pending, commonly assigned, U.S. application Ser. No. 07/998,157, Szajewski et al., "A Method Of Bleaching And Fixing A Color Photographic Element Containing High Iodide Emulsions" and U.S. application Ser. No. 07/998,156, Szajewski et al., "A Method Of Bleaching And Fixing A Low Silver Color Photographic Element", both filed Dec. 29, 1992.

FIELD OF THE INVENTION

This invention relates to the processing of color silver halide photographic recording elements. More particularly, it relates to the desilvering of a color silver halide photographic element using a peracid bleach and a sodium thiosulfate fixing agent.

BACKGROUND OF THE INVENTION

The basic image-forming process of color photography comprises the exposure of a silver halide photographic recording material to light, and the chemical processing of the material to reveal a usable image. The chemical processing entails two fundamental steps. The first is the treatment of the exposed silver halide with a color developer wherein some or all of the silver halide is reduced to metallic silver while an organic dye is formed from the oxidized color developer. The second is the removal of the silver metal thus formed and of any residual silver halide by the desilvering steps of 1) bleaching, wherein the developed silver is oxidized to silver salts; and 2) fixing, wherein the silver salts are dissolved and removed from the photographic material. The bleaching and fixing steps may be performed sequentially or as a single step.

It is highly desirable to process a photographic recording material as rapidly as possible, and an accelerated process is constantly being sought. In particular, shortening the silver removal step, which consumes almost half of the total process time, is an attractive way in which to shorten the overall processing time.

Juxtaposed to the desire for an accelerated process is the desire for, and the need for, photographic elements and process solutions that require lower chemical usage and that generate less polluting chemical waste. Used or spent fixer solutions are desilvered by electrochemical means to recover the semi-precious metal, but these solutions may still contain ingredients that limit their direct discharge into public waste water streams. Further treatment is required for them to conform to standards for environmentally acceptable disposal. In some photographic processes, higher processing speed can be traded for an indirect advantage in the form of lower processing chemistry usage and lower processing waste per unit of photographic material processed. Thus, these desires or goals are interrelated.

Numerous materials and methods suitable for the bleaching of metallic silver deposits have been described. Chief among the more useful bleaching or oxidizing agents are the higher oxidation states of various metals such as cerium, magnesium, chromium, vanadium, and iron, and the peracids, which include peroxide, persulfate, and their salts. The peracid bleaches may require the presence of a bleach accelerator to enable adequate bleaching. Likewise, many materials and methods suitable for the fixing or dissolution of silver salts and their removal from films are also known.

Commonly used fixing agents are the various salts of thiosulfate and thiocyanate, although other silver complexing anions have also been employed from time to time. This field of endeavor is generally reviewed in T. H. James, ed., *The Theory of the Photographic Process*, Macmillan, N.Y., 1977, and in particular at Chapter 15, entitled "Complementary Processes", pages 437 to 461 of this text. Additional teachings are shown at *Research Disclosure*, December, 1989, item 308119, published by Kenneth Mason Publications, Ltd., The Old Harbourmaster's, 8 North Street, Emsworth, Hampshire P010 7DD, England, hereinafter referred to as *Research Disclosure*, and in particular, at Section XIX, entitled "Processing" of this publication.

For reasons related to cost and efficacy, the photographic processing industry has focused on the use of chelated iron bleaches and thiosulfate fixers for the desilvering of color photographic materials. It is well appreciated in the art that the benefits of thiosulfate fixers are enhanced in the presence of ammonium ion. Fixer solutions containing ammonium thiosulfate are more active and solubilize silver halide in a photographic element more rapidly than thiosulfate salts of other cations. Thus, owing to its rapid fixing action, ammonium thiosulfate is widely used as a photographic fixing agent.

In recent years, however, the need to provide diminished environmental impact from photographic processing solutions has led to increased interest in means of rendering photographic bleaches and fixers ecologically benign. A useful means for making photographic fixer solutions environmentally more acceptable, including those fixer solutions that employ thiosulfate anion as a fixing moiety, has been substituting sodium ion for ammonium ion as the cationic counterion in the fixer solution. The reduction or total removal of the more common ammonium ion from the processing solution enables reduced aquatic toxicity and reduced biological oxygen demand in wastewater streams. Use of sodium thiosulfate fixing agents has been disclosed, for example, in U.S. Pat. No. 2,195,405 and in the *Theory of the Photographic Process* and *Research Disclosure* cited above.

This substitution of sodium ion for ammonium ion is, however, commercially undesirable since sodium thiosulfate tends to be a poorer fixing agent than ammonium thiosulfate and thus requires either higher concentrations of fixing agent or longer fixing times to enable adequate silver salt dissolution. Various solutions to this problem have been disclosed. Specific processes utilizing color photographic recording materials comprising tabular grain emulsions with sodium thiosulfate fixer solutions to enable improved fixing are disclosed in U.S. Pat. No. 5,183,727. Other attempts have been made to shorten the fixing process using various fixing accelerators. The use of low iodide films also reduces fixing time as described in G.B. 1,476,330, page 1, lines 50 to 58, and U.S. Pat. No. 4,960,683, column 16, lines 17 to 28.

Many combinations of sequential bleaching and fixer solutions and unitary bleach-fix solutions have been disclosed over the years. Typical examples are shown in the *Research Disclosure* and *Theory of the Photographic Process* cited above. With the current emphasis on ecologically sound processing, processes that utilize peracid bleaches are especially preferred since these bleaches tend to have a low environmental impact. A specific process utilizing a photographic recording material comprising high tabularity tabular grain emulsions in combination with peracid bleaches is disclosed in allowed U.S. patent application Ser. No. 07/891,601 entitled "Method Of Processing A Photographic Element With A Peracid Bleach," filed Jun. 1, 1992, now U.S. Pat. No. 5,318,880.

A process which includes the ecological advantages of both a peracid bleach and a sodium thiosulfate fixer is highly desirable, however, such a process has been thought to sacrifice speed in desilvering. Photographic processes utilizing both a persulfate bleach solution, a species of peracid bleach, and a sodium thiosulfate fixer solution are incidentally disclosed as examples in U.S. Pat. Nos. 4,448,878; 4,481,290; 4,458,010; 4,506,007 and 4,508,816. These publications are directed at bleaching improvements and disclose numerous combinations of different bleaches with various fixers. The sodium thiosulfate fixer solutions incidentally illustrated in these publications are used at high concentrations and long fixing times so as to ensure adequate fixing. These are exactly the fixing conditions that would be anticipated as useful based on the known inferiority of sodium thiosulfate as a fixative agent. No mention is made of any differences in the fixing behavior of photographic recording materials as a result of the composition of the bleaching agent employed. There is no suggestion of any fixing benefit to be drawn from a photographic process combining any specific bleaching solution and a fixer solution comprising sodium thiosulfate.

There remains a need for an environmentally sound method of desilvering developed photographic images without sacrificing the speed at which these images can be provided to a customer.

SUMMARY OF THE INVENTION

This invention provides a method of desilvering an imagewise exposed and developed color silver halide photographic element, said method comprising bleaching the photographic element with a peracid bleach and subsequently fixing the photographic element with a fixer solution comprising thiosulfate anion and sodium cation;

wherein the Molar-minute fixing time is less than about 0.2 Molar-minutes$\times m^2/g$ Ag$\times$the grams of incorporated silver per square meter of the photographic element.

This invention provides a method of desilvering that is fast and environmentally sound. It demonstrates that a fixer using sodium thiosulfate actually fixes more efficiently when the bleach that is utilized is an environmentally desirable peracid bleach rather than an iron chelate bleach. This surprising increase in efficiency allows for lower concentrations of sodium thiosulfate in the fixer or shorter fixing times than expected by those skilled in the art. This will make it more desirable for the processing industry to use sodium thiosulfate fixers, which will reduce the amount of ammonium in the processing effluent. Thus, both steps of the desilvering process will be more environmentally benign.

FIGURES

FIG. 1 depicts the synergistic fixing advantage which is obtained as a function of quantity of silver incorporated in a photographic element to be desilvered. The circled numbers shown refer to the photographic samples in the Examples. The area to the right of the slanted line is the area of synergistic effect.

DETAILED DESCRIPTION OF THE INVENTION

It has been found that when a silver halide photographic element is bleached in a peracid bleach, the photographic element may be effectively fixed when the Molar-minute fixing time is less than about 0.2 Molar-minutes$\times m^2/g$ Ag times the quantity of silver incorporated in the photographic element. The quantity of incorporated silver is the grams of silver ion and silver metal present in the photographic element before the element has been exposed to light or to a process solution. Molar-minute fixing time is the product of the molar concentration of the thiosulfate anion in a fixer solution before fixing commences multiplied by the contact time of the photographic element with the fixer solution.

It is only when the Molar-minute fixing time and silver content are held in balance that the full effect of the invention can be achieved. The surprising improvement in fixer efficacy provided by this combination is not available when the more common chelated iron bleaches are employed instead of a peracid bleach, when more concentrated fixer solutions are employed or when longer fixer contact times are employed.

It is preferred that the Molar-minute fixing time be less than about 0.19 Molar-minutes$\times m^2/g$ Ag times the silver content and even more preferred that it be less than about 0.18 Molar-minutes$\times m^2/g$ Ag times the silver content. In a most preferred embodiment, the Molar-minute fixing time is less than about 0.15 Molar-minutes$\times m^2/g$ Ag times the silver content.

Although the fixing or dissolution of silver salts from a photographic sample can be a chemically complex process, at its simplest level, the efficacy of removal of silver salt from a photographic sample may be thought of as being proportional to the concentration of fixing agent in the solution and proportional to the time of contact of the photographic sample with the fixer solution. Therefore, the efficacy of a fixing step can be increased by either increasing the concentration of fixing agent or by increasing the time of contact of the photographic sample with the fixer solution, and one may be able to maintain efficacy by simultaneously increasing one while decreasing the other.

Thus, the efficacy of a fixer solution, or the Molar-minute fixing time, can be described as the multiplicative product of the concentration of fixing agent in the fixer solution (in units of moles per liter or M) and the contact time of the photographic sample with that fixing agent (in units of minutes). For purposes of this invention the Molar-minute fixing time must be adjusted for the effect of the amount of sodium cation vs. ammonium cation by dividing the above multiplicative product by the mole-fraction of sodium cation relative to that of sodium and ammonium cation. In this way, one may compare a variety of fixer solutions that have been employed for a variety of contact times as being related through the product of the concentration of fixing agent and the contact time, that is, each solution and each time can be described as a unique product that has units of Molar-minutes (abbreviated as M-min).

For example, a sodium thiosulfate fixer solution that contains 0.9M thiosulfate and is in contact with a photographic sample for 2 minutes would have a Molar-minute fixing time of (0.9M×2 minutes)=1.8 M-min. In another example, a fixer solution that contains 0.9M thiosulfate, 1.4M sodium and 0.4M ammonium would have a sodium ion mole-fraction (1.4/ 1.4+0.4)=0.778. This solution in contact with a photographic sample for 2 minutes would have a Molar-minute fixing time of (0.9M×2 minutes/0.778)=2.314 M-min. As can be seen, ammonium ion increases the Molar-minute fixing time. The fixer solution containing ammonium would undoubtedly be more effective at fixing but less environmentally desirable.

While larger values of the Molar-minute fixing time are certainly useful in achieving complete fixing, the advantages enabled by the invention become less apparent under these conditions. Molar-minute fixing times of less than about 1.8 M-min are therefore preferred to enable the advantages of this invention. Molar-minute fixing times of less than about 1.6 M-min are more preferred, while Molar-minute fixing times of less than about 1.4 M-min are most preferred for realizing the full benefits of this invention.

Preferably, the thiosulfate used in the fixer solutions of this invention is present at a concentration from about 0.05M to about 3.0M, with 0.1M to 1.0M being preferred. The thiosulfate may be supplied by ammonium thiosulfate, sodium thiosulfate, potassium thiosulfate, lithium thiosulfate, magnesium thiosulfate, or calcium thiosulfate, or mixtures of these thiosulfates. Counterions to the thiosulfate may come from the thiosulfate or from other fixer solution ingredients.

Regardless of the source of the counterions, a portion of the counterions must be sodium ions. The proportion of sodium counterions can be equivalently expressed as a percent or as a mole-fraction. Preferably at least 25%, i.e. a mole-fraction of 0.25, of the counterions are sodium ion, with at least 50% being more preferred and at least 75% being even more preferred. For environmental purposes, it is desirable that substantially all, that is in excess of 95%, of the counterions be sodium and that the fixing agent be substantially sodium thiosulfate.

Preferably, the concentration of ammonium in the fixer solution of this invention is less than 1.5M, and more preferably, less than 0.8M. The ammonium may come from the ammonium thiosulfate or from other fixer ingredients. The advantages of this invention are fully realized by utilizing a fixer solution that contains a low concentration of ammonium, or contains no or substantially no ammonium. For purposes of this invention, "substantially no ammonium" signifies the absence of ammonium intentionally added to the fixer formulation or intentionally added to a solution used to replenish the fixer solution during processing. Ammonium ion or ammonium species (collectively called "ammonium") which unintentionally occur as impurities, or which are carried into the fixer solution by color photographic recording material, may be present in the fixer.

In all cases, the concentrations of thiosulfate, ammonium, sodium and so forth present in a fixer solution are those determined immediately before contact of a photographic element with the fixer solution. The time of contact of a photographic element with a fixer solution is the time between the first contact of a particular portion of a photographic element with the fixer solution to the time that that same portion of the photographic element either contacts a subsequent solution or is dewatered either by drying or by mechanical means, as for example by application of a squeegee, all as known in the art.

Potassium ion in the fixer can retard the action of this invention. Preferably, the concentration of potassium ion in a fixer solution useful in this invention is less than about 0.5M, more preferably less than about 0.1M, and even more preferably less than about 0.01M. The potassium may come from potassium thiosulfate or from other fixer solution ingredients. The advantages of this invention are fully realized by utilizing a fixer solution that contains a low concentration of potassium, or contains no or substantially no potassium. For the purposes of this invention "substantially no potassium" signifies the absence of potassium intentionally added to the fixer solution or to a solution used to replenish the fixer solution during processing. Potassium ion which unintentionally occurs as impurities, or which is carried into the fixer solution by a color photographic element, may be present in the fixer.

The time of contact of the photographic element with the fixer solution is preferably 5 seconds to 600 seconds. More preferably, the time of contact is 15 seconds to 380 seconds, and most preferably about 30 seconds to 240 seconds.

In the preferred embodiments, the concentration of thiosulfate is about 0.1M to 3.0M with the proportion of the sodium ion as counterion being 100%. The preferred contact time for the photographic element with the fixer solution is 30 seconds to 380 seconds. The preferred embodiments contain no ammonium ion.

Other characteristics of the fixer solution are those that are typical of fixer solutions in the art. For example, the concentration of thiosulfate in the fixer solution can be from about 0.05 molar or less to as high as solubility in the processing solution allows, but it is preferred that this concentration be as described above. The pH of the fixer solution may range from about 3 to as high as about 12, but it is generally preferred that the pH be between 4 and 10. The fixer solution can optionally contain a source of sulfite or bisulfite ion. If the fixer solution is to be used at a pH below about 7, it is preferred to include a source of sulfite or bisulfite ion in the fixer solution. For example, sodium or potassium sulfite, sodium or potassium bisulfite, or sodium or potassium metabisulfite can be used. The concentration of this source of sulfite or bisulfite ion is generally from about 0.01 molar to about 0.5 molar. To control solution pH, various buffering agents may be used in the fixer solution, including the above-mentioned sulfite or bisulfite sources, acetate salts, citrates, tartrates, borates, carbonates, phosphates, etc.

In addition to thiosulfate and sulfite or bisulfite, the fixer solution can contain one or more other compounds known to be fixing agents. Such compounds include thiocyanate salts, thiourea and thiourea derivatives, organic thioethers and thioacids, thione compounds, thiosemicarbazones, organic thiols, amines, and imides. Patent and technical literature references to these and other compounds may be found in Chapter 59 of *Comprehensive Coordination Chemistry*, Vol. 6, G. Wilkinson, ed., Pergamon, Oxford, 1987.

If a film hardening action is desired for the fixer solution, it may contain one or more ingredients to effect film hardening and to stabilize the hardening agent in the fixer solution. Such ingredients include potassium alum, aluminum sulfate, aluminum chloride, boric acid, sodium tetraborate, gluconic acid, tartaric acid, citric acid, acetic acid and sodium acetate, for example.

The fixer solution may contain one or more substances which are known to accelerate film fixing. These materials are described in Chapter 15 of *The Theory of the Photographic Process,* 4th Edition, T. H. James, ed., Macmillan, N.Y., 1977. Such substances include ammonium salts, such as ammonium chloride (within the content limitations mentioned above), ethylenediamine, and other amines, such as guanidine, which are capable of providing organic ammonium cations that accelerate the fixing process. Other accelerators are thiourea and its derivatives.

The fixer solution may also contain compounds for the prevention of precipitation of metal salts of metals that are initially present in or that become introduced into the fixer solution during use. Such metals include iron, copper, zinc, magnesium, calcium, aluminum, and chromium, among others. Metal sequestering agents, chelating agents, and precipitation control agents may be used to control these metals. Examples of these metal control agents are polycarboxylic acids such as citric acid and tartaric acid; aminocarboxylic acids such as nitrilotriacetic acid, ethylenedinitrilotetraacetic acid (EDTA), and diethylenetriaminepentaacetic acid; organophosphonic acids such as nitrilotris(methylenephosphonic) acid and 1-hydroxyethylidene-1,1-diphosphonic acid; orthodihydroxybenzene compounds such as 4,5-dihydroxy-m-benzenedisulfonic acid; acyclic or cyclic polyphosphates; and various polymers such as polyacrylic acids.

The concentrations of the fixer solution constituents during processing can be regulated by the usual controlling factors, namely, fixer replenishment rates and replenishing component concentrations, water losses due to evaporation, evaporative losses of volatile components other than water, the amounts and compositions of processing liquids carried into and out of the fixer solution by the photographic recording material, the amount of solution overflow from other vessels containing processing solutions that is introduced into the fixer solution, the amount of solid component carried into the fixer solution by the photographic recording material and then dissolved in the fixer solution, the rate of removal or replacement of any constituent by means such as ion exchange, electrolysis, electrodialysis, and the like.

Typical peracid bleaches useful in this invention include the hydrogen, ammonium, alkali and alkali earth salts of persulfate, peroxide, perborate, perphosphate, and percarbonate, and the related perhalogen bleaches such as hydrogen, alkali and alkali earth salts of chlorate, bromate, iodate, perchlorate, perbromate and metaperiodate. Examples of formulations using these agents are described in *Research Disclosure,* December 1989, Item 308119, published by Kenneth Mason Publications, Ltd., Dudley Annex, 12a North Street, Emsworth, Hampshire P010 & DQ, England, the disclosures of which are incorporated herein by reference. This publication will be identified hereafter as *Research Disclosure.*

Additional hydrogen peroxide formulations are described in U.S. Pat. Nos. 4,277,556; 4,328,306; PCT/EP91/01377 (filed 24 Jul. 1991) of Marsden et al.; PCT/EP91/01973 (filed 17 Oct. 1991) of Fyson et al.; U.S. Pat. Nos. 4,454,224; 4,717,649. Especially preferred are persulfate bleaches and peroxide bleaches, with sodium, potassium, or ammonium persulfate being particularly preferred. For reasons of economy and stability, sodium persulfate is most commonly used. The bleaching agent can be present in any effective concentration. Preferred concentrations are from 0.01 to 1.0 moles/liter, more preferably from 0.05 to 0.5 moles/liter of bleaching agent.

Water is employed as a solvent for the bleaching solution. Both acidic and alkaline peracid bleach solutions are known. When persulfate bleaches are used, the pH of the bleaching solution is maintained on the acid side of neutrality within conventional ranges, typically in the range of from about 1 to 7, more preferably from about 1.5 to 6, and most preferably from pH 2 to 5. The bleaching solution may contain a buffer consisting of an organic acid or inorganic acid and/or a salt thereof. Useful examples include phosphoric acid and salts of phosphate, citric acid and salts of citrate, boric acid and salts of borate or metaborate, acetic acid and salts of acetate, and carbonate salts.

The bleaching solution may contain a chloride salt such as sodium chloride, potassium chloride, or ammonium chloride, or a bromide salt such as sodium bromide, potassium bromide, or ammonium bromide. In a preferred embodiment, the peracid bleach is a chloride rehalogenating bleach. A chloride rehalogenating bleach is a bleach that contains chloride ion and converts metallic silver to silver chloride.

Various compounds may be used to accelerate bleaching with these peracid bleaches. Representative compounds are disclosed in U.S. Pat. Nos. 3,707,374; 3,772,020; 3,820,997; 3,870,520; 3,893,858; 4,446,225; 4,458,010; 4,506,007; 4,508,816; 4,508,817; 4,578,345; 4,865,956; 5,011,763; *Research Disclosure* No. 20821 (1989); *Research Disclosure* No. 15704 (1977); DD 141,727; DE 3,234,467; DE 3,919,550; DE 3,919,551; JP 1,292,339. These materials may be used in a pre-solution, added to the persulfate solution, or coated in the photographic element in quantities sufficient to enable bleach acceleration. Examples of preferred accelerators include dimethylaminoethanethiol, dimethylaminoethanethiol isothiouronium salt, aminoethanethiol, and morpholinoethanethiol. When used in a pre-solution or in the bleaching solution itself, the accelerator may be used at a concentration of 0.002 to 0.2 moles/liter, with 0.005 to 0.05 preferred. When the bleach accelerators are incorporated in the photographic element, preferred accelerators are silver morpholinoethanethiol, silver aminoethanethiol, and silver dimethylaminoethanethiol, at a concentration of 0.05 to 0.5 g/m$^2$.

Metal ion catalysed peracid bleaches as described in German Application DE 3,919,551 A1 and U.S. Pat. No. 4,277,556 (Koboshi) are also useful in the practice of this invention. Ferric ion catalysed peracid bleaches and specifically ferric ion catalysed persulfate bleaches utilizing ferric complexes of 2,6-pyridinecarboxylic acid or 2,6-pyridinedicarboxylic acid, as described in copending U.S. application Ser. No. 08/101,136, entitled "Photographic Persulfate Bleaches With Ferric Catalysts" by Buchanan et al., filed Aug. 2, 1993, hereby incorporated by reference, are especially preferred for use in this invention.

Scavengers for halogen may be added to the persulfate solution as disclosed in *Research Disclosure* No. 17556 (1978) and U.S. Pat. Nos. 4,292,401 and 4,293,639. Other useful discussions of the application of persulfate to photographic bleaching appear in the *Journal of the Society of Motion Picture and Television Engineers*

(SMPTE), Vol. 91, pp. 158–163 (1982); *SMPTE*, Vol. 91, pp. 1058–1065; and Eastman Kodak Publication H-24, *Manual for Processing Eastman Color Films* (December, 1988).

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in U.S. Pat. No. 4,362,806.

The element can contain additional layers such as filter layers, interlayers, overcoat layers, subbing layers and the like. In a preferred embodiment, the element may comprise a red light sensitive color record comprising one or more red light sensitive silver halide emulsion layers each in reactive association with a cyan dye-forming coupler, a green light sensitive color record comprising one or more green light sensitive silver halide emulsion layers each in reactive association with a magenta dye-forming coupler, and a blue light sensitive color record comprising one or more blue light sensitive silver halide emulsion layers each in reactive association with a yellow dye forming coupler. Any image dye forming coupler known in the art may be employed The element may also comprise compounds capable of releasing a photographically useful group. Among the compounds that may be incorporated in a photographic element employed in this invention are the known development inhibitor releasing compounds and known the bleach accelerator releasing compounds. These may be employed individually in a particular element or they may be employed in combination as known in the art. The development inhibitor releasing compounds will preferably enable release of either sulfur ligand development inhibitor moieties or more preferably nitrogen ligand development inhibitor moieties. Among the bleach accelerator releasing compounds known in the art, those which enable release of a solubilized aliphatic mercaptan are preferred. Typically useful dye-forming couplers and couplers capable of releasing a photographically useful group are illustrated by commercial practice and in the examples which follow.

The total thickness of these light sensitive layers and additional layers will generally be between about 5 and 35 microns. While the thicker formulation can provide improved physical handling and scratch resistance properties, the thinner formulations provide improved access of processing solutions to all portion of an element. A good balance of these properties can be achieved by elements with a total thickness between about 10 and 30 microns while elements with a total thickness between about 12 and 27 microns are preferred. More swellable film structures also provide improved access of processing solutions to all portions of an element. Wet to dry swell ratios of greater than 3:2 are useful while swell ratios of greater than 2:1 or even 3:1 are preferred. Further, this invention may be particularly useful with a magnetic recording layer such as those described in *Research Disclosure*, No. 34390, p. 869, (November, 1992), due to the decreased Dmin of color elements associated with peracid bleaches.

The silver halide emulsions employed in the elements of this invention are preferably negative-working emulsions. Examples of suitable emulsions and their preparation are described in *Research Disclosure* Sections I and II and the publications cited therein. Some of the suitable vehicles for the emulsion layers and other layers of elements of this invention are described in *Research Disclosure* Section IX and the publications cited therein.

The most useful photographic elements for this invention will contain less than about 20 grams of silver per square meter of film support. It is preferred that the element contain between about 0.7 and 12 grams of silver per square meter of film support. When the element is specifically a color negative camera speed originating film intended for printing or scanning, i.e. an element with a sensitivity of greater than about ISO 25, and preferably a sensitivity of between about ISO 25 and ISO 3200, the more preferred quantity of silver will be between about 1 and 11 grams per square meter. When the element is a conventionally developed color display film intended for viewing the quantity of silver will be between about 0.3 and 4 grams per square meter, and the most preferred quantity of silver will be between about 0.7 and 3 grams per square meter. When the element is specifically a color paper as exemplified by KODAK EDGE PHOTOGRAPHIC PAPER or FUJI type FA PHOTOGRAPHIC PAPER, the more preferred quantity of incorporated silver will be between about 0.3 and 1 gram of silver per square meter of film support. Use of this invention to advantageously desilver such color papers is specifically contemplated. When the element is a motion picture color print film or an advertising display material, the preferred quantity of silver will be between about 0.6 and 4 grams per square meter, and the most preferred quantity of silver will be between about 0.7 and 3 grams per square meter. When the element is a color material intended for hydrogen peroxide amplified color development, the preferred quantity of silver will be between about 0.05 and 0.6 grams per square meter.

The silver halide emulsions can be chemically and spectrally sensitized in a variety of ways, examples of which are described in Sections III and IV of the *Research Disclosure*. The elements of the invention can include various couplers including, but not limited to, those described in *Research Disclosure* Section VII, paragraphs D, E, F, and G and the publications cited therein. These couplers can be incorporated in the elements and emulsions as described in *Research Disclosure* Section VII, paragraph C, and the publications cited therein.

The photographic elements of this invention or individual layers thereof can contain among other things brighteners (Examples in *Research Disclosure* Section V), antifoggants and stabilizers (Examples in *Research Disclosure* Section VI), antistain agents and image dye stabilizers (Examples in *Research Disclosure* Section VII, paragraphs I and J), light absorbing and scattering materials (Examples in *Research Disclosure* Section VIII), hardeners (Examples in *Research Disclosure* Section X), plasticizers and lubricants (Examples in *Research Disclosure* Section XII), antistatic agents (Examples in *Research Disclosure* Section XIII), matting agents (Examples in *Research Disclosure* Section XVI), and development modifiers (Examples in *Research Disclosure* Section XXII).

The photographic elements can be coated on a variety of supports including, but not limited to, those described in *Research Disclosure* Section XVII and the references described therein. Particularly preferred are reflective and transparent supports.

Photographic elements can be exposed to actinic radiation, typically in the visible region of the spectrum, to form a latent image as described in *Research Disclosure* Section XVIII and then processed to form a visible dye image, examples of which are described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Since the fixing and bleaching are separate steps in the overall process, many alternative processing sequences are compatible with the invention. In the processing of color negative photographic recording materials, these sequences would include a development step prior to a bleaching step, which in turn precedes a fixing step.

Generally, a stabilization step follows a fixing step. One or more intervening processing steps may come before the development, bleaching, fixing, and/or the stabilization steps. In addition, some processing steps, such as washing steps, may be deleted from the processing cycle. Examples of such modifications to the processing cycle contemplated by the invention include: a pre-solution and/or washing cycle before development; a stop solution, bleach accelerator solution, and/or washing treatment after the development step and before the bleaching step; and omission of the washing steps before and/or after the fixing step. The benefits of this invention can also be realized by placing an additional fixing step between the development step and the bleach step. Conventional techniques for processing are illustrated by *Research Disclosure*, paragraph XIX.

It is specifically contemplated to employ low volume photographic processing apparatus as known in the art, including that described in U.S. Pat. Nos. 5,179,404 and 5,270,762 and in the related applications disclosed therein, the disclosures of which are incorporated by reference. Use of high velocity solution impingement as described in U.S. Pat. No. 5,116,721, the disclosure of which is incorporated by reference, is also specifically contemplated. It is also specifically contemplated that fixer solutions employed in the practice of this invention will be replenished, regenerated and reused all as known in the art.

Preferred processing sequences for color photographic elements, particularly color negative films and color print papers, which can be used with this invention, include the following:

(P-1) Color Development/Stop/Bleaching/ Washing/Fixing/Washing/Stabilizing/Drying.

(P-2) Color Development/Stop/Bleaching/ Fixing-/Washing/Stabilizing/Drying.

(P-3) Color Development/Stop-Fixing/Bleaching /Fixing/Washing/Stabilizing/Drying.

(P-4) Color Development/Bleaching/Washing/ Fixing/Washing/Stabilizing/Drying.

While each of the processes described above can be varied, the bleaching step is, in each instance, performed using a peracid-bleaching agent.

The following examples are provided to illustrate the invention and are not intended to limit it in any way.

EXAMPLES

Example 1

Preparation Of Samples 101 Through 114

The Photographic Samples were prepared using known materials and methods.

Photographic Samples 101 to 104 and 112 to 114 were prepared by applying the following layers to a clear support: two red light-sensitive layers in a red sensitive element, two green light-sensitive layers in a green sensitive element, two blue sensitive layers in a blue light-sensitive element along with subbing layers, antihalation and UV-absorbing layers, interlayers, and protective layers as known in the art.

Photographic Sample 105 was prepared by applying the following layers to a clear support: two red light-sensitive layers in a red sensitive element, three green light-sensitive layers in a green sensitive element, two blue sensitive layers in a blue light-sensitive element along with subbing layers, antihalation and UV-absorbing layers, interlayers, and protective layers as known in the art.

Photographic Samples 106 to 109 and 111 were prepared by applying the following layers to a clear support: three red light-sensitive layers in a red sensitive element, three green light-sensitive layers in a green sensitive element, two blue sensitive layers in a blue light-sensitive element along with subbing layers, antihalation and UV-absorbing layers, interlayers, and protective layers as known in the art.

Photographic Sample 110 was prepared by applying the following layers to a clear support: three red light-sensitive layers in a red sensitive element, three green light-sensitive layers in a green sensitive element, three blue sensitive layers in a blue light-sensitive element along with subbing layers, antihalation and UV-absorbing layers, interlayers, and protective layers as known in the art.

The ISO-speed, morphology and silver, halide, and vehicle content of samples 101 through 114 are as described in Table I.

TABLE I

| | | Film Composition Features | | | | | |
|---|---|---|---|---|---|---|---|
| | | Iodide | | Grain Morphology | | Film | |
| Sample | Silver g/m$^2$ | Average Mol % | Range | AR & Tabularity Ranges | Vehicle g/m$^2$ | Thickness (microns) | ISO Speed |
| 101 | 7.28 | 5.6 | (3.0%–12%) | AR = 2–5, T = 8–33 Conventional | 14.46 | 20.8 | ca. 100 |
| 102 | 7.93 | 3.6 | (1.3%–9%) | AR = 2–25, T = 7–260 Conventional & Tabular | 19.42 | 25.6 | 400 |
| 103 | 9.16 | 4.6 | (2.6%–9%) | AR = 2–27, T = 5–250 Conventional & Tabular | 20.83 | 27.2 | 1600 |
| 104 | 10.17 | 6.7 | (4.8%–12%) | AR = 2–5, T = 14–22 Conventional | 16.40 | 22.9 | 160 |

TABLE I-continued

| | | Film Composition Features | | | | | |
|---|---|---|---|---|---|---|---|
| | | Iodide | | Grain Morphology | | Film | |
| Sample | Silver g/m$^2$ | Average Mol % | Range | AR & Tabularity Ranges | Vehicle g/m$^2$ | Thickness (microns) | ISO Speed |
| 105 | 7.32 | 5.0 | (0.5%-6%) | AR = 1-20, T = 1-100 Tabular & Octahedral | 17.33 | 23.0 | 200 |
| 106 | 3.45 | 3.7 | | AR = 5-15, T = 20-110 Tabular | 15.86 | 20.5 | 200 |
| 107 | 3.45 | 3.7 | | AR = 5 -15, T = 20-110 Tabular | 15.86 | 20.5 | 200 |
| 108 | 3.75 | 3.7 | | AR = 5 -15, T = 20-110 Tabular | 15.86 | 20.6 | 200 |
| 109 | 3.75 | 3.7 | | AR = 5-15, T = 20-110 Tabular | 15.86 | 20.6 | 200 |
| 110 | 6.69 | 12.5 | (4%-16%) | AR = 2-5, T = 8-20 Conventional | 17.47 | 19.5 | 400 |
| 111 | 7.06 | 3.7 | | AR = 3-25, T = 2-150 Conventional & Tabular | 20.10 | 25.5 | 500 |
| 112 | 6.02 | 3.7 | | AR = 3-25, T = 70-125 Tabular | 17.53 | 22 | 500 |
| 113 | 4.49 | 3.0 | (0.1%-6%) | AR = 1 -9, T = 2-110 Cubic & Tabular | 15.66 | 19.5 | 25 |
| 114 | 3.52 | 3.7 | | AR = 3-25, T = 70-125 Tabular | 17.53 | 20.8 | 500 |

mol % I refers to entire photographic material;
range shows iodide mol % content of individual emulsions;
AR is aspect ratio;
T is tabularity;
Thickness is from the front surface of the film to the top of the support.

Photographic samples 101 through 114 employed the following image dye-forming couplers, image modifiers, masking couplers, dyes and so forth:

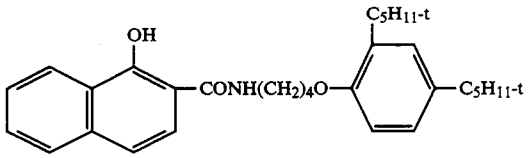

C-1

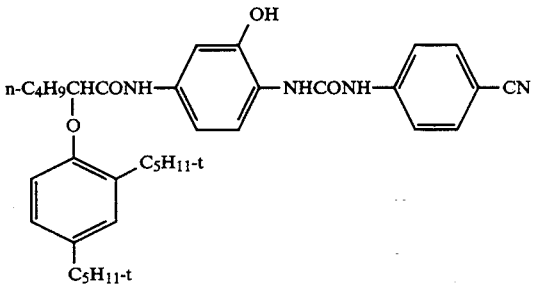

C-2

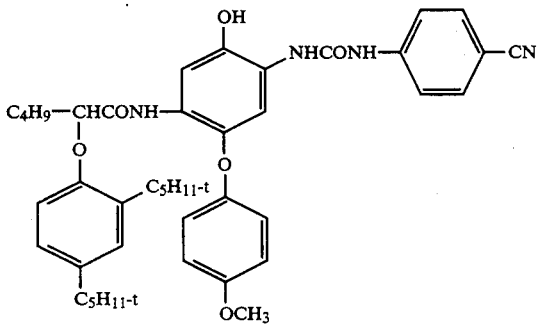

C-3

-continued
C-4
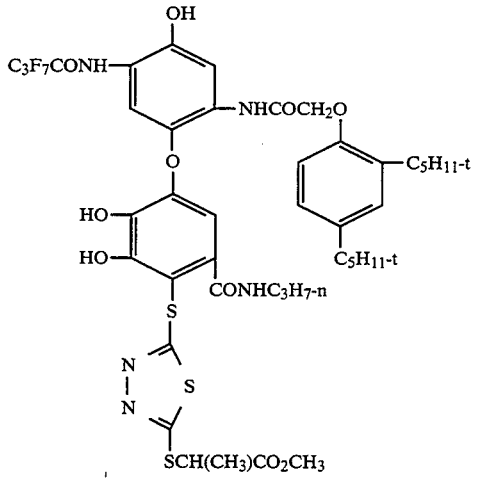
C-95
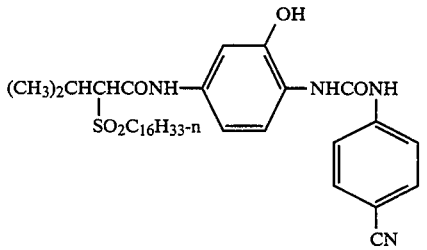
C-6
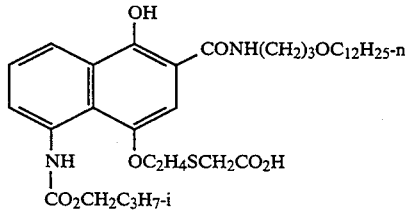
C-7
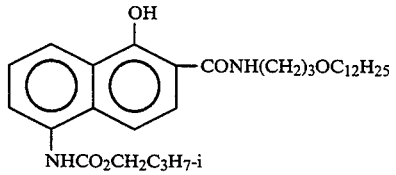
C-8
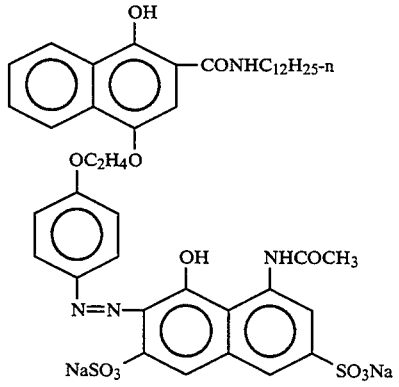

-continued
C-9
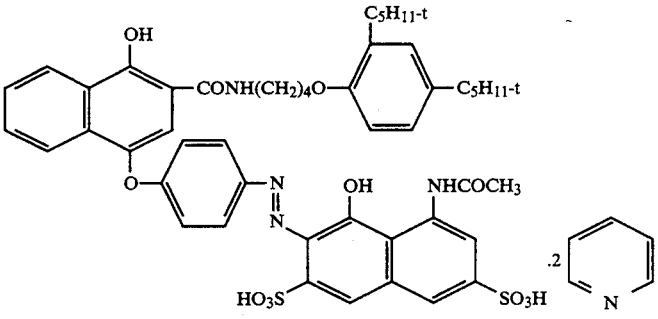
C-10
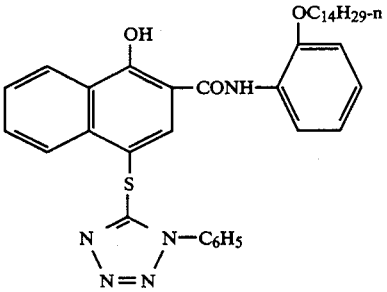
C-11
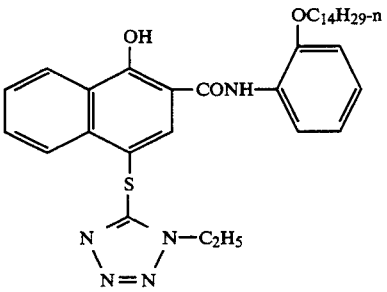
C-12
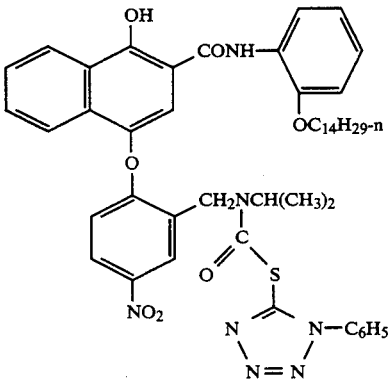

-continued
C-13
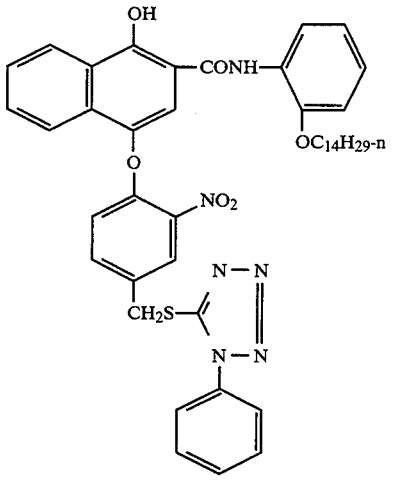
C-14
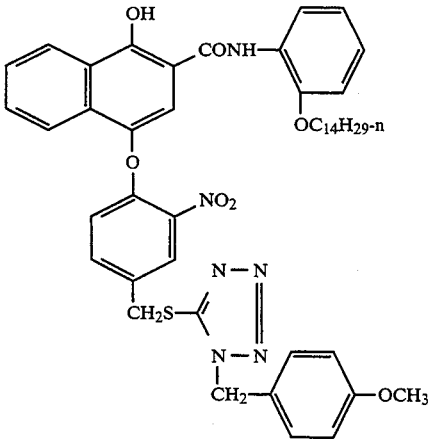
C-15
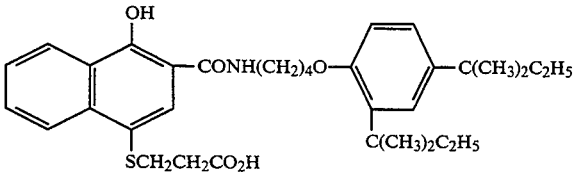
C-16
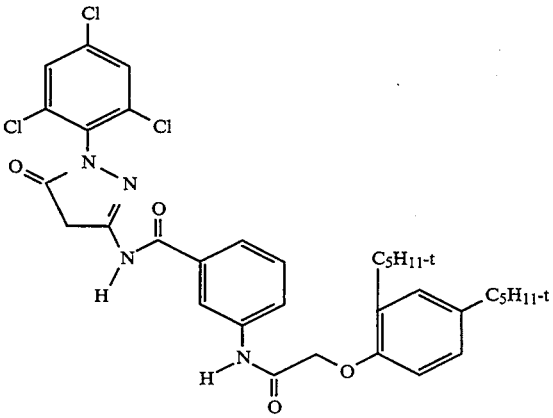

-continued
C-17
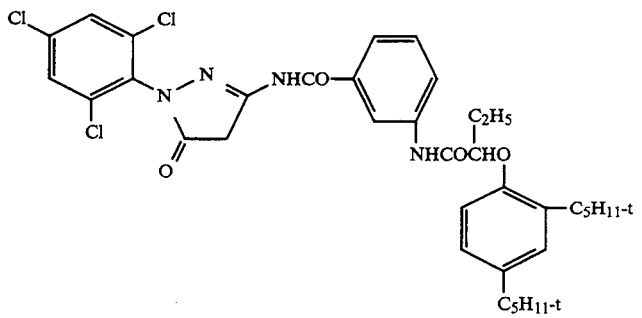
C-18
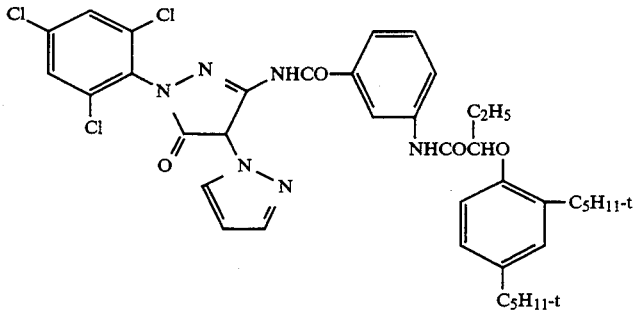
C-19
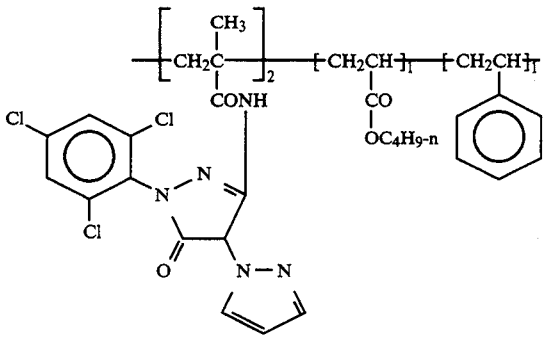
C-20
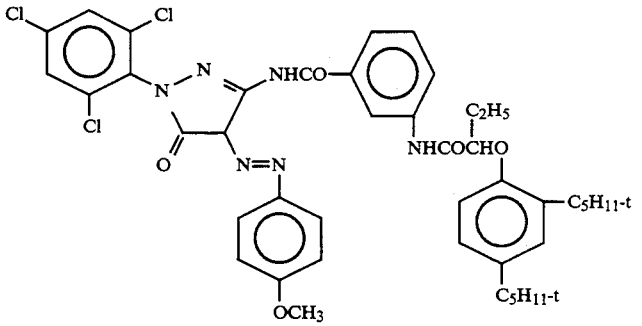
C-21
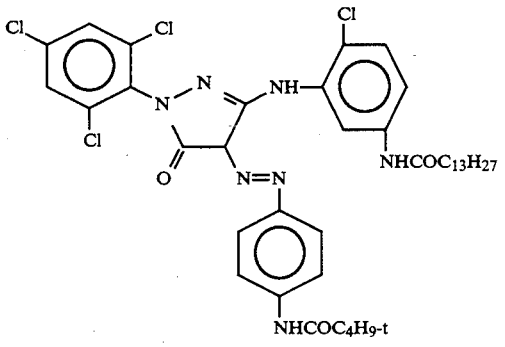

-continued
C-22
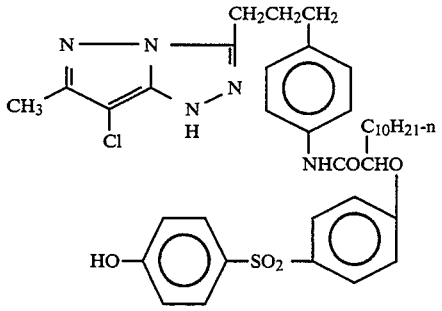
C-23
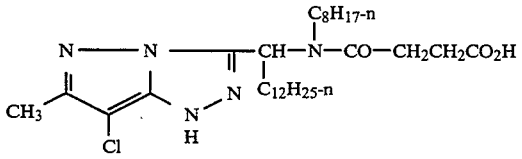
C-24
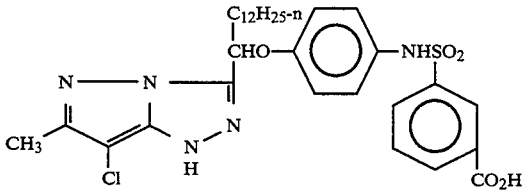
C-25
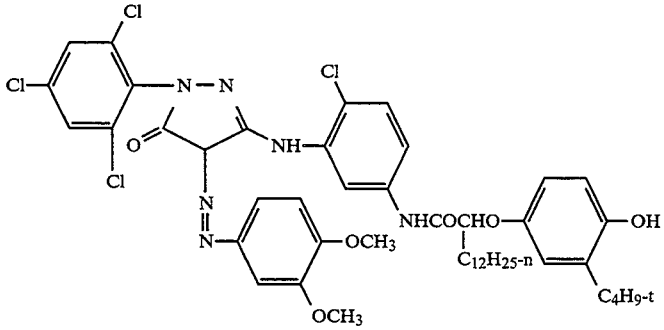
C-26
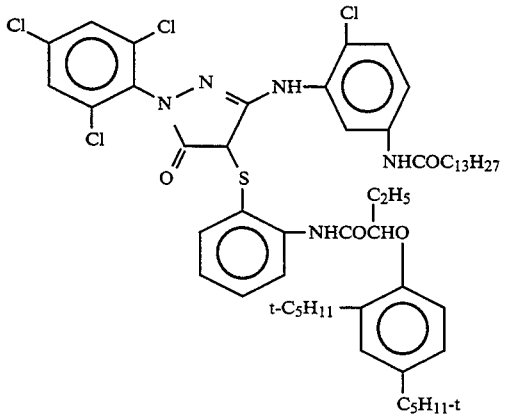

-continued
C-27
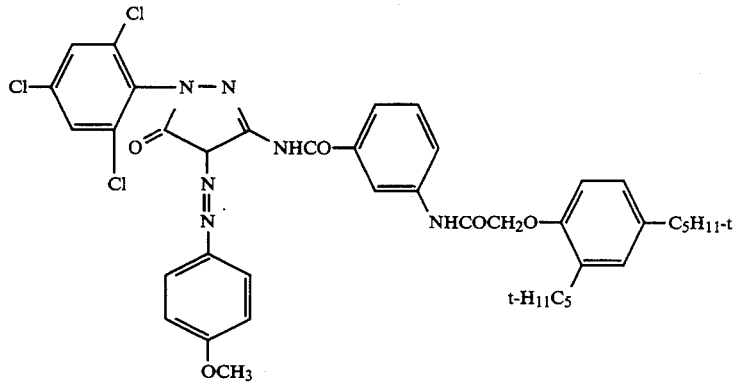
C-28
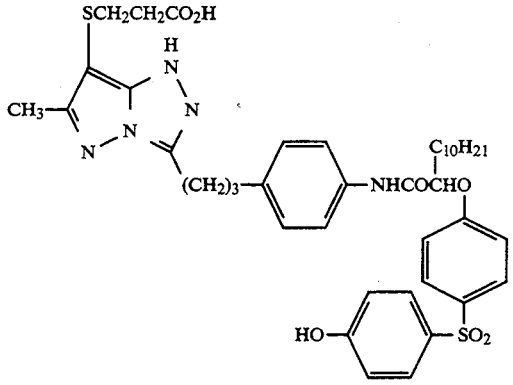
C-29
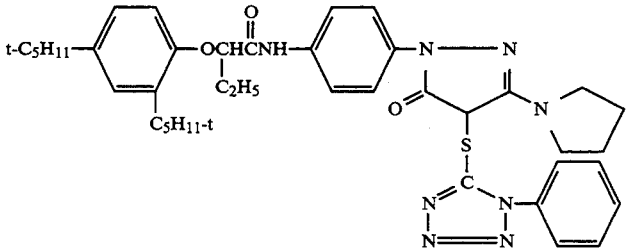
C-30
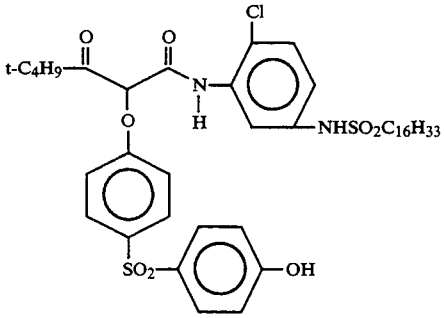
C-31
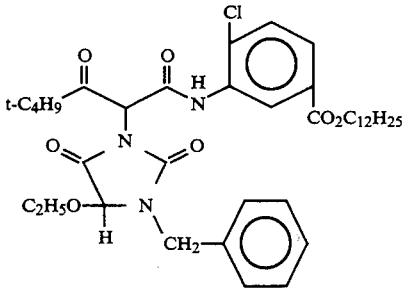

-continued
C-32
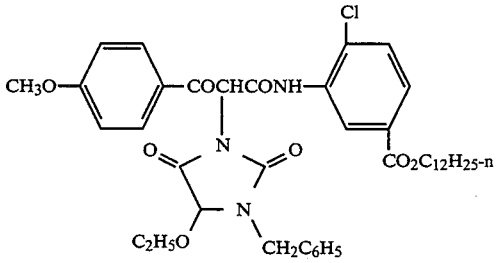
C-33
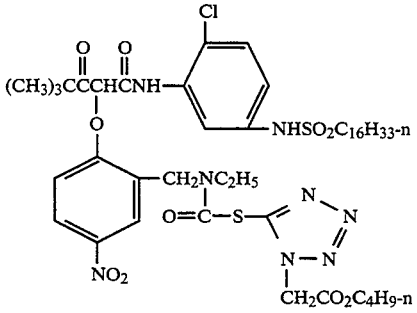
C-34
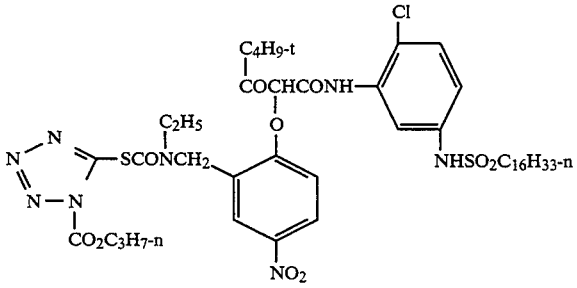
C-35
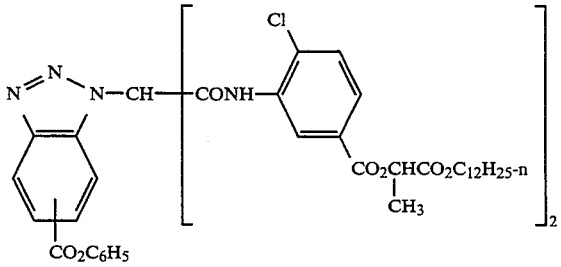
D-1
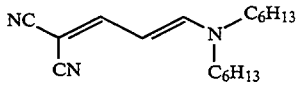
D-2
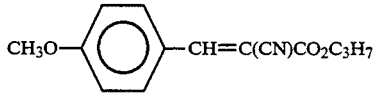
D-3
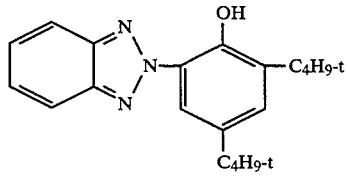

-continued
D-4
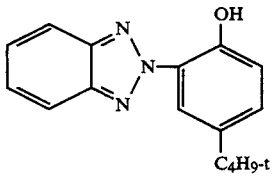
D-5
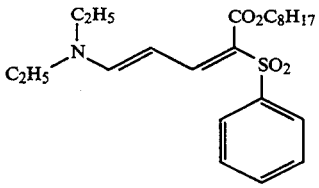
D-6
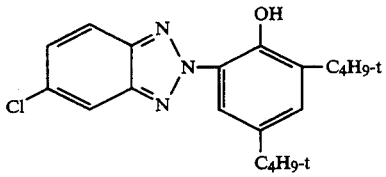
D-7
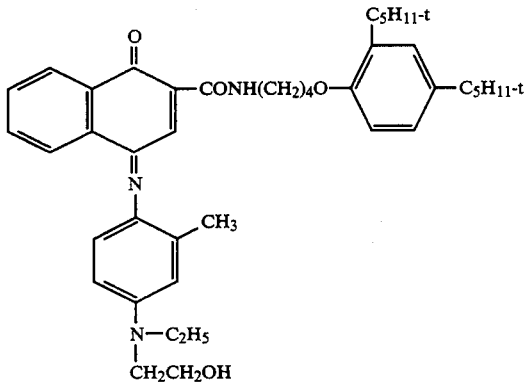
D-8
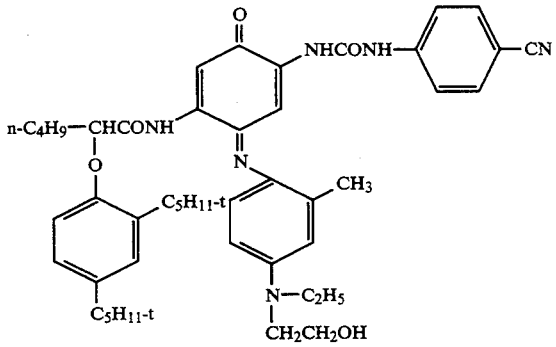
D-9
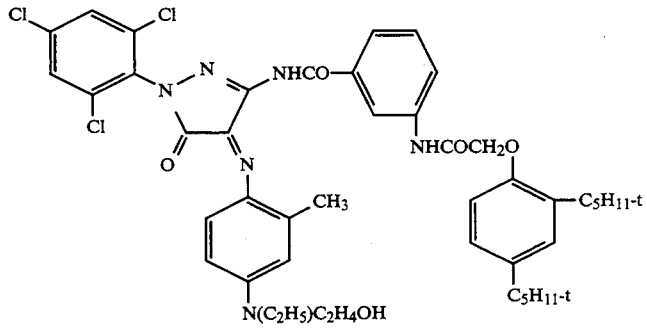

-continued
D-10
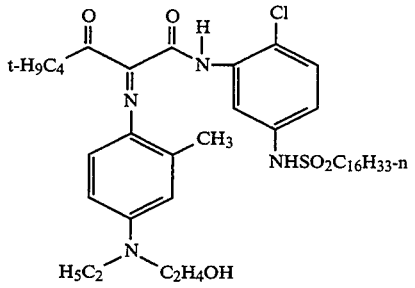
D-11
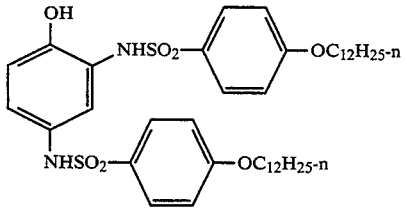
D-12
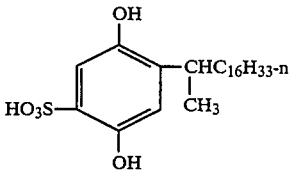
D-13
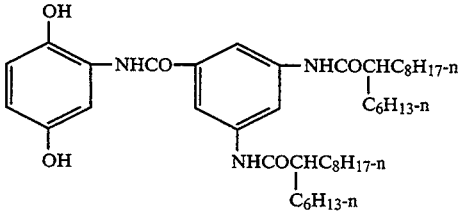
D-14
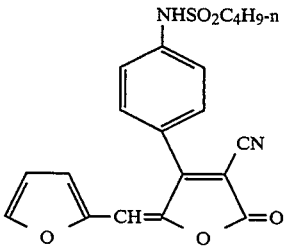
D-15
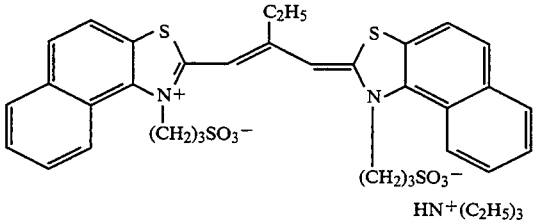
D-16
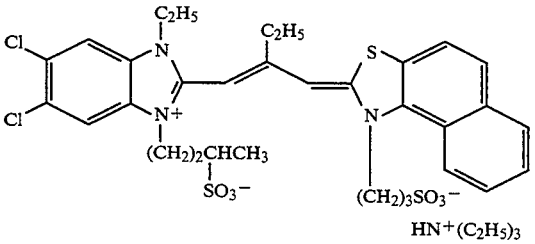

-continued
D-17
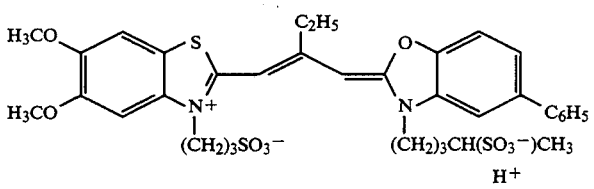
D-18
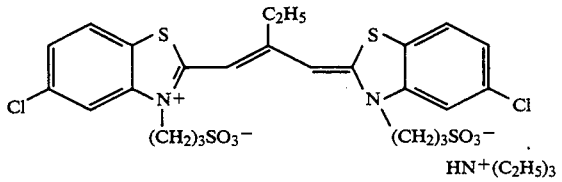
D-19
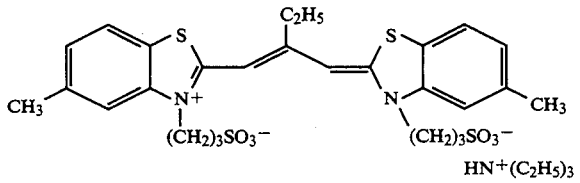
D-20
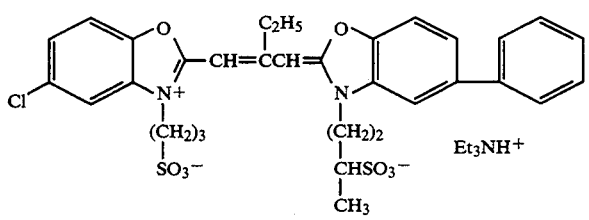
D-21
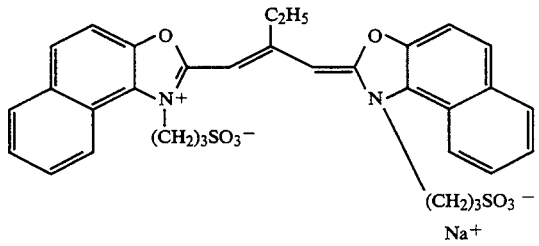
D-22
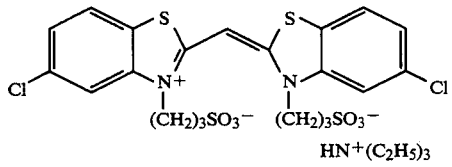
D-23
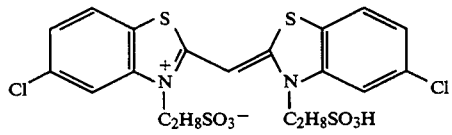
D-24
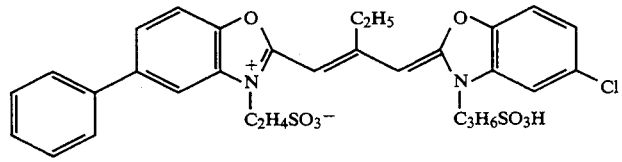

-continued

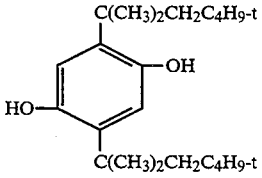

S-1

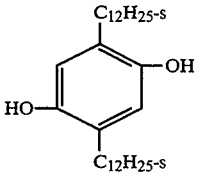

S-2

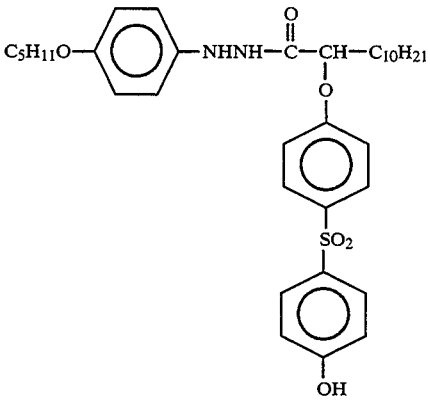

S-3

Example 2

The samples were exposed to light through a gray wedge test object and processed as described below:

| | | | |
|---|---|---|---|
| | | Process A | |
| Develop | 195" | | 38° C. |
| Stop | 60" | | 38° C. |
| Wash | 60" | | 38° C. |
| Bleach | 240" | Ferric Chelate Bleach | 38° C. |
| Wash | 180" | | 38° C. |
| Fix | Varies | $Na_2S_2O_3$ | 38° C. |
| Wash | | | 38° C. |
| Rinse | | | |
| | | Process B | |
| Develop | 195" | | 38° C. |
| Stop | 60" | | 38° C. |
| Wash | 60" | | 38° C. |
| Accelerator | 60" | | 38° C. |
| Bleach | 240" | Persulfate | 38° C. |
| Wash | 180" | | 38° C. |
| Fix | Varies | $Na_2S_2O_3$ | 38° C. |
| Wash | | | 38° C. |
| Rinse | | | |
| | | Process C | |
| Develop | 195" | | 38° C. |
| Stop | 60" | | 38° C. |
| Wash | 60" | | 38° C. |
| Bleach | 240" | Fe-cat. Persulfate | 38° C. |
| Wash | 180" | | 38° C. |
| Fix | Varies | $Na_2S_2O_3$ | 38° C. |
| Wash | | | 38° C. |
| Rinse | | | |

The process solution compositions were as follows:

| | |
|---|---|
| Developer | |
| Water | 800.00 mL |
| Potassium carbonate, anhydrous | 34.30 g |

-continued

| | |
|---|---|
| Potassium bicarbonate | 2.32 g |
| Sodium sulfite, anhydrous | 0.38 g |
| Sodium metabisulfite | 2.96 g |
| Potassium iodide | 1.20 mg |
| Sodium bromide | 1.31 g |
| Diethylenetriaminepentaacetic acid pentasodium salt (40% solution) | 8.43 g |
| Hydroxylamine sulfate | 2.41 g |
| KODAK Color Developing Agent CD-4 (N-(4-amino-3-methylphenyl)N-ethyl aminoethanol) | 4.52 g |
| Water to make | 1.00 L |
| pH @ 80° F. 10.00 ± 0.05 | |
| Stop | |
| Water | 900.00 mL |
| Sulfuric acid (18M) | 10.00 mL |
| Water to make | 1.00 L |
| pH @ 80° F. 0.90 | |
| Ferric Chelate Bleach | |
| Water | 500.00 mL |
| 1,3-propylenediamine tetraacetic acid | 37.40 g |
| 57% ammonium hydroxide | 70.00 mL |
| Acetic acid | 80.00 mL |
| 2-hydroxy- 1,3-propylenediamine tetraacetic acid | 37.40 g |
| Ammonium bromide | 25.00 g |
| Ferric nitrate nonahydrate | 44.85 g |
| Water to make | 1.00 L |
| pH 4.75 | |
| Rinse | |
| Water | 900.00 mL |
| 0.5% Aqueous p-tertiary-octyl-(α-phenoxypolyethyl)-alcohol | 3.00 mL |
| Water to make | 1.00 L |
| Accelerator | |
| Water | 800.00 mL |
| Sodium metabisulfite dihydrate | 10.00 g |
| Acetic acid | 25.00 mL |
| Sodium acetate | 10.00 g |
| (Ethylenedinitrilo) tetraacetic acid tetrasodium salt | 0.70 g |
| Dimethylaminoethanethiol isothiouronium salt | 5.50 g |
| Water to make | 1.00 L |

-continued

| | |
|---|---|
| pH 4.12 @ 98° F. | |
| Persulfate Bleach | |
| Water | 800.00 mL |
| Gelatin hydrolysate | 0.50 g |
| Sodium persulfate | 33.00 g |
| Sodium chloride | 15.00 g |
| Sodium dihydrogen phosphate | 10.35 g |
| Phosphoric acid (85% solution) | 2.50 mL |
| pH @ 80° F. 2.3 ± 0.2 (adj w/phosphoric acid) | |
| Water to make | 1.00 L |
| Fe-catalyzed Persulfate Bleach | |
| Water | 800.00 mL |
| 2,6-Pyridinedicarboxylic Acid | 4.60 g |
| Ferric nitrate nonahydrate | 5.05 g |
| Sodium persulfate | 59.50 g |
| Sodium chloride | 8.75 g |
| Acetic acid | 5.72 mL |
| Ammonium hydroxide | 10.00 mL |
| pH @ 78° F. 4.0 (adj. w/sodium hydroxide) | |
| Water to make | 1.00 L |
| Sodium Thiosulfate Fix | |
| Sodium thiosulfate pentahydrate | 204.70 g |
| Sodium bisulfite dihydrate | 17.10 g |
| pH @ 78° F. 6.52 (adj. w/sodium hydroxide) | |
| Water to make | 1.00 L |

The quantity of silver retained in the various photographic samples at a Dmax exposure was monitored after processing using X-ray fluorescence techniques. These quantities are reported in Table II below. Also reported in Table II are the contact times (expressed in seconds) of the various photographic samples tested with the fixer solutions. The fixer solution employed in all of these experiments has a concentration of 0.825 mole of thiosulfate per liter (e.g., 0.825M).

As described earlier, the efficacy of the fixing process may be related to the contact time of the photographic samples with the fixer solutions multiplied by the concentration of fixing agent in the fixer solution. Because the proportion of sodium as counterion was 100%, there was no need to divide by this variable.

For the contact times employed in the illustrative examples of Table II, these products are:

| | | |
|---|---|---|
| for 20 seconds | 0.275 M-min | (e.g., 0.333 min times 0.825 mole of thiosulfate per liter); |
| for 30 seconds | 0.413 M-min; | |
| for 40 seconds | 0.55 M-min; | |
| for 60 seconds | 0.825 M-min; | |
| for 120 seconds | 1.65 M-min; | |
| for 240 seconds | 3.3 M-min. | |
| and so forth | | |

TABLE II

Photographic Sample, Process Identity, Fixer Solution Contact Time And Quantity Of Silver Retained After Processing At A Dmax Exposure

| Photographic Sample | Process | Time Of Fix (in seconds) | Silver At Dmax (in g/m**2) |
|---|---|---|---|
| 101 (Control) | A | 20 | 3.615 |
| 101 (Control) | A | 40 | 2.163 |
| 101 (Control) | A | 60 | 0.652 |
| 101 (Control) | A | 120 | 0.028 |
| 101 (Control) | A | 240 | 0.039 |
| 101 | B | 20 | 1.679 |
| 101 | B | 40 | 0.733 |
| 101 | B | 60 | 0.425 |
| 101 | B | 120 | 0.031 |
| 101 | B | 240 | 0.029 |
| 101 | C | 20 | 3.239 |
| 101 | C | 40 | 1.410 |

TABLE II-continued

Photographic Sample, Process Identity, Fixer Solution Contact Time And Quantity Of Silver Retained After Processing At A Dmax Exposure

| Photographic Sample | Process | Time Of Fix (in seconds) | Silver At Dmax (in g/m**2) |
|---|---|---|---|
| 101 | C | 60 | 0.196 |
| 101 | C | 120 | 0.049 |
| 101 | C | 240 | 0.041 |
| 102 (Control) | A | 20 | 4.003 |
| 102 (Control) | A | 40 | 2.174 |
| 102 (Control) | A | 60 | 0.938 |
| 102 (Control) | A | 120 | 0.059 |
| 102 (Control) | A | 240 | 0.015 |
| 102 | B | 20 | 2.668 |
| 102 | B | 40 | 0.718 |
| 102 | B | 60 | 0.469 |
| 102 | B | 120 | 0.099 |
| 102 | B | 240 | 0.020 |
| 102 | C | 20 | 3.605 |
| 102 | C | 40 | 1.797 |
| 102 | C | 60 | 0.843 |
| 102 | C | 120 | 0.029 |
| 102 | C | 240 | 0.012 |
| 103 (Control) | A | 20 | 4.465 |
| 103 (Control) | A | 40 | 2.636 |
| 103 (Control) | A | 60 | 1.399 |
| 103 (Control) | A | 120 | 0.031 |
| 103 (Control) | A | 240 | 0.029 |
| 103 | B | 20 | 2.959 |
| 103 | B | 40 | 1.023 |
| 103 | B | 60 | 0.523 |
| 103 | B | 120 | 0.145 |
| 103 | B | 240 | 0.020 |
| 103 | C | 20 | 3.970 |
| 103 | C | 40 | 2.389 |
| 103 | C | 60 | 1.237 |
| 103 | C | 120 | 0.023 |
| 103 | C | 240 | 0.025 |
| 104 (Control) | A | 30 | 5.176 |
| 104 (Control) | A | 60 | 3.131 |
| 104 (Control) | A | 120 | 0.549 |
| 104 (Control) | A | 240 | 0.022 |
| 104 | B | 30 | 2.970 |
| 104 | B | 60 | 0.834 |
| 104 | B | 120 | 0.238 |
| 104 | B | 240 | 0.001 |
| 105 (Control) | A | 30 | 1.937 |
| 105 (Control) | A | 60 | 1.205 |
| 105 (Control) | A | 120 | 0.013 |
| 105 (Control) | A | 240 | 0.028 |
| 105 | B | 30 | 1.506 |
| 105 | B | 60 | 0.387 |
| 105 | B | 120 | 0.133 |
| 105 | B | 240 | 0.000 |
| 106 | B | 30 | 0.524 |
| 106 | B | 60 | 0.083 |
| 106 | B | 120 | 0.038 |
| 106 | B | 240 | 0.022 |
| 107 | B | 30 | 0.543 |
| 107 | B | 60 | 0.059 |
| 107 | B | 120 | 0.058 |
| 107 | B | 240 | 0.000 |
| 108 | B | 30 | 0.533 |
| 108 | B | 60 | 0.104 |
| 108 | B | 120 | 0.090 |
| 108 | B | 240 | 0.015 |
| 109 | B | 30 | 0.520 |
| 109 | B | 60 | 0.104 |
| 109 | B | 120 | 0.097 |
| 109 | B | 240 | 0.031 |
| 110 (Control) | A | 10 | 3.488 |
| 110 (Control) | A | 20 | 2.747 |
| 110 | B | 10 | 1.309 |
| 110 | B | 25 | 1.116 |
| 111 (Control) | A | 10 | 4.555 |
| 111 (Control) | A | 20 | 3.451 |
| 111 (Control) | A | 30 | 2.511 |
| 111 (Control) | A | 40 | 1.655 |
| 111 (Control) | A | 60 | 0.717 |
| 111 (Control) | A | 120 | 0.036 |

TABLE II-continued

| Photographic Sample, Process Identity, Fixer Solution Contact Time And Quantity Of Silver Retained After Processing At A Dmax Exposure | | | |
|---|---|---|---|
| Photographic Sample | Process | Time Of Fix (in seconds) | Silver At Dmax (in g/m**2) |
| 111 Control) | A | 240 | 0.026 |
| 111 | B | 10 | 3.374 |
| 111 | B | 25 | 1.577 |
| 111 | B | 35 | 0.630 |
| 111 | B | 45 | 0.682 |
| 111 | B | 60 | 0.601 |
| 111 | B | 120 | 0.145 |
| 111 | B | 240 | 0.021 |
| 112 (Control) | A | 10 | 3.995 |
| 112 (Control) | A | 20 | 2.906 |
| 112 (Control) | A | 30 | 1.920 |
| 112 (Control) | A | 40 | 1.229 |
| 112 (Control) | A | 60 | 0.200 |
| 112 (Control) | A | 120 | 0.046 |
| 112 (Control) | A | 240 | 0.036 |
| 112 | B | 10 | 2.606 |
| 112 | B | 25 | 0.649 |
| 112 | B | 35 | 0.532 |
| 112 | B | 45 | 0.500 |
| 112 | B | 60 | 0.370 |
| 112 | B | 120 | 0.072 |
| 112 | B | 240 | 0.031 |
| 113 (Control) | A | 10 | 2.551 |
| 113 (Control) | A | 20 | 1.714 |
| 113 (Control) | A | 30 | 1.062 |
| 113 (Control) | A | 40 | 0.550 |
| 113 (Control) | A | 60 | 0.032 |
| 113 (Control) | A | 120 | 0.021 |
| 113 (Control) | A | 240 | 0.019 |
| 113 | B | 10 | 1.513 |
| 113 | B | 25 | 0.518 |
| 113 | B | 35 | 0.555 |
| 113 | B | 45 | 0.469 |
| 113 | B | 60 | 0.270 |
| 113 | B | 120 | 0.060 |
| 113 | B | 240 | 0.019 |
| 114 (Control) | A | 10 | 1.511 |
| 114 (Control) | A | 20 | 0.704 |
| 114 (Control) | A | 30 | 0.193 |
| 114 (Control) | A | 40 | 0.050 |
| 114 (Control) | A | 60 | 0.036 |
| 114 (Control) | A | 120 | 0.046 |
| 114 (Control) | A | 240 | 0.031 |
| 114 | B | 10 | 0.511 |
| 114 | B | 25 | 0.400 |
| 114 | B | 35 | 0.341 |
| 114 | B | 45 | 0.152 |
| 114 | B | 60 | 0.060 |
| 114 | B | 120 | 0.053 |
| 114 | B | 240 | 0.028 |

As can be readily appreciated upon examination of the comparative data provided in Table II above for the fixing of the photographic samples, contact with a peracid bleach solution before contact with a sodium salt fixer solution results in an unexpected improvement in the efficacy of fixing of the photographic samples relative to that shown in the control process A. This illustrates the practical advantage of being able to employ an ecologically sound sodium salt fixer solution for a shorter period of time or at a lower concentration than would be expected. This unexpected advantage holds true both when an accelerated peracid bleach solution is used as in process B or when a metal catalyzed peracid bleach solution is used as in process C, before the photographic sample contacts the fixer solution. This unexpected advantage is especially apparent under milder fixing conditions than are described in the art. Table III further illustrates the fixing advantages of this invention.

TABLE III

| Relative Fixing Rates | | | |
|---|---|---|---|
| | | Time To Remove | |
| | | 75% | 90% |
| Sample | Process | Of Silver | |
| 101 | A (Control) | 44 Sec | 59 Sec |
| | B | 19 Sec | 41 Sec |
| | C | 34 Sec | 51 Sec |
| 102 | A (Control) | 43 Sec | 70 Sec |
| | B | 27 Sec | 38 Sec |
| | C | 38 Sec | 62 Sec |
| 103 | A (Control) | 44 Sec | 80 Sec |
| | B | 27 Sec | 48 Sec |
| | C | 41 Sec | 69 Sec |
| 104 | A (Control) | 74 Sec | 130 Sec |
| | B | 36 Sec | 58 Sec |
| 105 | A (Control) | 34 Sec | 82 Sec |
| | B | 28 Sec | 53 Sec |
| 110 | A (Control) | 34 Sec | 49 Sec |
| | B | 9 Sec | 43 Sec |
| 111 | A (Control) | 38 Sec | 61 Sec |
| | B | 24 Sec | 34 Sec |
| 112 | A (Control) | 37 Sec | 53 Sec |
| | B | 18 Sec | 30 Sec |
| 113 | A (Control) | 29 Sec | 45 Sec |
| | B | 17 Sec | 45 Sec |
| 114 | A (Control) | 18 Sec | 28 Sec |
| | B | 9 Sec | 27 Sec |

Example 3

Samples 110 through 114 were processed using simulated seasoned processing solutions and similar results were obtained, e.g., the combination of a peracid bleach followed by a high sodium thiosulfate fixer resulted in rapid fixing of the photographic samples.

Example 4

Photographic Samples 401 and 402 were prepared generally as described in Example 1 by applying a red light sensitive color record, a green light sensitive color record and a blue light sensitive color record to a support along with interlayers, overcoat layers and the like. These samples further comprised image couplers, development inhibitor releasing compounds which enable release of nitrogen-ligand development inhibitors, interlayer scavengers, absorber dyes coating aids and surfactants and the like as previously described. The total quantity of silver employed was about 2.56 g/m$^2$, the total quantity of gelatin employed as vehicle was 9.9 g/m$^2$ and the total thickness of the samples above the support was about 12.9 microns.

Sample 401 comprised silver iodobromide emulsions with an average iodide content of 4.8 mol percent and individual emulsions ranging from 3.7 mol percent iodide to 9 mol percent iodide. All emulsions were tabular in shape with an average Aspect Ratio range of 4 to 12 and an average Tabularity range of 18 to 130.

Sample 402 was like sample 401 except that the silver iodobromide emulsions were replaced by tabular shaped, <100>-faced silver chloride emulsions comprising less than about 3 mole percent bromide and less than about 0.1 mole percent iodide. These emulsions were like those described at U.S. application Ser. No. 08/112,489, allowed, and U.S. Pat. Nos. 5,264,337 and 5,292,632, the disclosures of which are incorporated by reference.

Samples 401 and 402 were imagewise exposed and developed. The samples were then bleached either in the Ferric Chelate Bleach described in Example 2 or in the Fe-catalysed Persulfate Bleach-II described below.

They were subsequently fixed in seasoned Sodium Thiosulfate Fixers-I, -II or -III, with compositions as described below, for various times.

| Fe-catalysed Persulfate Bleach-II | | |
|---|---|---|
| 2,6-Pyridinedicarboxylic Acid | 2.3 | g/L |
| Glacial Acetic Acid | 5.75 | ml/L |
| Ferric Nitrate nonahydrate | 2.53 | g/L |
| Sodium Persulfate | 29.8 | g/L |
| Sodium Chloride | 14.6 | g/L |
| Sodium Hydroxide (50% solution) | 0.54 | ml/L |
| Sodium Carbonate (2.4 M solution) | 3.25 | ml/L |
| Water to make | 1 | L with pH at 3.5 |
| Sodium Thiosulfate Fixer-I | @ | |
| Sodium Thiosulfate | @ | 0.3 M |
| Sodium Sulfite | @ | 0.0073 M |
| Silver Bromide | @ | 0.01 M |
| Sodium Bromide | @ | 0.034 M |
| Sodium Iodide | @ | 0.0019 M |
| Free Thiosulfate Concentration | | 0.28 M |
| Sodium Thisoulfate Fixer-II | @ | |
| Sodium Thiosulfate | @ | 0.2 M |
| Sodium Sulfite | @ | 0.0049 M |
| Silver Bromide | @ | 0.01 M |
| Sodium Bromide | @ | 0.036 M |
| Free Thiosulfate Concentration | | 0.18 M |
| Sodium Thisoulfate Fixer-III | @ | |
| Sodium Thiosulfate | @ | 0.1 M |
| Sodium Sulfite | @ | 0.0024 M |
| Silver Chloride | @ | 0.01 M |
| Sodium Bromide | @ | 0.0014 M |
| Sodium Chloride | @ | 0.035 M |
| Free Thiosulfate Concentration | | 0.08 M |

Sample 401 was developed in the Developer described in Example 2 for 195 sec, bleached with either Ferric Chelate Bleach or Fe-catalysed Persulfate Bleach-II and then contacted with Sodium Thiosulfate Fixer-I for various times ranging from about 15 sec to about 240 sec. The fixer clearing time, that is the time required to remove all fixable silver, was determined for Sample 401 in each of these two processes. Sample 401 showed a clearing time of 105 sec in Fixer-I after using the ferric-chelated bleach and showed a clearing time of 90 sec in Fixer-I after using the metal catalysed peracid bleach. The effective Molar-minute fixing time to clear Sample 401 after using the iron chelate bleach was 0.49 M-min. The effective Molar-minute fixing time to clear Sample 401 after using the metal catalysed peracid bleach was 0.42 M-min, thus demonstrating the surprising improvement in fixing enabled by the selection of bleach composition according to the current invention.

Sample 402 was developed for 60 sec using the development procedure described in U.S. Pat. Nos. 4,892,804 and 4,957,357. It was then bleached with Ferric Chelate Bleach and then contacted with Sodium Thiosulfate Fixer-II or alternatively bleached with Fe-catalysed Persulfate Bleach-II and then contacted with Sodium Thiosulfate Fixer-III for various times ranging from about 15 sec to about 240 sec. The fixer clearing time, that is the time required to remove all fixable silver, was determined for Sample 402 in each of these two processes. Sample 402 showed a clearing time of 70 sec in Fixer-II after using the ferric-chelated bleach and showed a clearing time of 75 sec in Fixer-III after using the metal catalysed peracid bleach. It can be seen that the clearing times were almost identical although Fixer III had only half the concentration of thiosulfate. The effective Molar-minute fixing time to clear Sample 402 after using the iron chelate bleach was 0.21 M-min. The effective Molar-minute fixing time to clear Sample 402 after using the metal catalysed peracid bleach was 0.10 M-min, thus demonstrating the surprising improvement in fixing enabled by the selection of bleach composition according to the current invention. Example 5

Photographic Samples 601 through 603 were prepared generally as described in Example 4. The total quantity of silver employed was about 2.9 g/m$^2$, the total quantity of gelatin employed as vehicle was 10.1 g/m$^2$ and the total thickness of the samples above the support was about 13.6 microns.

Sample 601 comprised <100> faced silver chloride tabular emulsions comprising about 0.5 mole percent iodide. Sample 602 comprised cubic silver chloride emulsions. Sample 603 comprised tabular silver iodibromide emulsions having an average iodide content of about 4.8 mol percent.

Samples 601 through 603 were imagewise exposed and then developed for 60 sec using the development procedure described in U.S. Pat. Nos. 4,892,804 and 4,957,357. They were bleached with Fe-catalysed Persulfate Bleach-II and then contacted with sodium thiosulfate fixer solutions having thiosulfate concentrations of 0.8, 0.11 or 0.13M for various times ranging from about 15 sec to about 240 sec. The fixer clearing time, that is the time required to remove all fixable silver was determined for each sample in each of these processes, and the effective Molar-minute fixing time required to enable clearing, taking into account both the contact time and the concentration of available thiosulfate was determined for each sample under each condition. These results are listed in Table IV, below.

TABLE IV

| | Molar-minute Fixing Time | | |
|---|---|---|---|
| | Free Thiosulfate Concentration | | |
| Sample | 0.08 M | 0.11 M | 0.18 M |
| 601 | 0.101 M-min | 0.099 M-min | 0.102 M-min |
| 602 | 0.108 M-min | 0.103 M-min | 0.093 M-min |
| 603 | 0.260 M-min | 0.276 M-min | 0.267 M-min |

This table demonstrates the constancy of effective clearing times, when expressed in units of Molar-minutes.

Example 6

The surprising relationship between quantity of silver incorporated in a photographic element and the ranges of effective Molar-minute fixing time enabled by the processing sequence of this invention can be best appreciated from a graphic presentation of data reported in Examples 1 through 5. This relationship is shown in illustrative FIG. 1. Here, the effective Molar-minute fixing times (expressed in units of M-min) observed on practice of the invention are plotted as a function of the quantity of silver (expressed in units of grams of silver per square meter of support) incorporated in the element subject to the process. The quantity of silver employed in each sample (x-axis) is taken from the Examples. The effective Molar-minute fixing times where a synergistic advantage is observed is derived for each sample either directly from the examples or by interpolating from the data reported in Table II, those effective Molar-minute fixing times for each sample when the use of a peracid bleach before a sodium thiosulfate fix enabled greater silver halide disolution and removal by the fixer solution than was enabled by use of a chelated iron bleach. As is readily apparent from this graphic representation, the synergistic fixing advantage available by the practice of this invention is directly related to the quantity of silver incorporated in a photographic element to be fixed. The advantages of this invention are apparent when the effective Molar-minute fixing time, expressed in units of M-min, is less than about 0.2×that quantity of silver, expressed in units of grams per square meter of support.

Example 7

A sample of Kodak EDGE paper, comprising about 0.8 grams of silver per square meter, was imagewise exposed, and then developed and bleached as described in Example 5. Individual portions were then contacted with a sodium thiosulfate fixer for times ranging from about 5 and 20 seconds. The Effective Molar-minute fixing time required to enable clearing after this processing sequence was found to be about 0.017 M-min. Likewise, samples of FUJICOLOR Paper, comprising about 0.55 grams of silver per square meter, were imagewise exposed and then developed and bleached as above. Individual portions were subsequently contacted with a sodium thiosulfate fixer for times ranging from about 5 to about 30 seconds. The Effective Molar-minute fixing time required to enable clearing after this processing sequence was found to be less than about 0.017 M-min. This example demonstrates the applicability of the method of bleaching and fixing to low silver photographic elements.

This invention has been described in detail with particular reference to preferred embodiments thereof, but it will be understood that variations and modifications can be effected within the spirit and scope of the invention.

What is claimed is:

1. A method of desilvering an imagewise exposed and developed color silver halide element, said method comprising bleaching the photographic element with a peracid bleach and subsequently fixing the photographic element with a fixer solution comprising thiosulfate anion and sodium cation;

wherein the Molar-minute fixing time is less than the quantity: 0.2 Molar-minute-$m^2$/g Ag×the grams of incorporated silver per square meter of the photographic element, wherein Molar-minute fixing time is the multiplicative product of the concentration of thiosulfate in said fixer solution in units of mol/1, and the contact time of said element with said fixer solution in units of minutes, divided by the mole fraction of sodium cation relative to the total of sodium and ammonium cations present in said fixer solution.

2. The method of claim 1 wherein the Molar-minute fixing time is less than the quantity: 0.19 Molar-minute-$m^2$/g Ag×the grams of incorporated silver per square meter of the photographic element, wherein Molar-minute fixing time is the multiplicative product of the concentration of thiosulfate in said fixer solution in units of mol/1, and the contact time of said element with said fixer solution in units of minutes, divided by the mole fraction of sodium cation relative to the total of sodium and ammonium cations present in said fixer solution.

3. The method of claim 1 wherein the Molar-minute fixing time is less than the quantity: 0.18 Molar-minute-$m^2$/g Ag×the grams of incorporated silver per square meter of the photographic element, wherein Molar-minute fixing time is the multiplicative product of the concentration of thiosulfate in said fixer solution in units of mol/1, and the contact time of said element with said fixer solution in units of minutes, divided by the mole fraction of sodium cation relative to the total of sodium and ammonium cations present in said fixer solution.

4. The method of claim 1 wherein the Molar-minute fixing time is less than about 1.8 Molar-minutes.

5. The method of claim 1 wherein the peracid bleach comprises a persulfate, perborate, percarbonate or peroxide moiety.

6. The method of claim 1 wherein the peracid bleach comprises an iron catalyzed peracid bleach.

7. The method of claim 1 wherein the peracid bleach is a chloride rehalogenating bleach.

8. The method of claim 1 wherein the fixer solution has an ammonium cation concentration of less than 0.8M.

9. The method of claim 1 wherein the fixer solution is substantially free of ammonium cation.

10. The method of claim 3 wherein the mole-fraction of sodium cation relative to all cations contained in said fixer solution is greater than about 0.50.

11. The method of claim 1 wherein the fixing agent in the fixer solution is substantially sodium thiosulfate.

12. The method of claim 1 wherein the fixer solution has a potassium cation concentration of less than about 0.1M.

13. The method of claim 1 wherein the photographic element is bleached in the presence of a bleach accelerator or bleach catalyst.

14. The method of claim 1 wherein the quantity of silver contained in the photographic element is between about 0.7 and about 12 grams per square meter.

15. The method of claim 1 wherein the photographic element is a negative working photographic element.

16. The method of claim 1 wherein the time of contact of the photographic element with the fixer solution is between about 15 to 380 seconds.

17. A method of desilvering an imagewise exposed and developed color silver halide photographic element, said method comprising bleaching the photographic element with a chloride rehalogenating persulfate bleach in the presence of a bleach accelerator or bleach catalyst, and subsequently fixing the photographic element with a fixer solution comprising thiosulfate anion and sodium cation;

wherein the Molar-minute fixing time is less than the smaller of 1.8 Molar-minutes or the quantity; 0.18 Molar-minute-$m^2$/g Ag×the grams of incorporated silver per square meter of the photographic element, wherein Molar-minute fixing time is the multiplicative product of the concentration of thiosulfate in said fixer solution in units of mol/1, and the contact time of said element with said fixer solution in units of minutes, divided by the mole fraction of sodium cation relative to the total of sodium and ammonium cations present in said fixer solution; and wherein the fixer solution is substantially free of ammonium cation and has a potassium cation concentration of less than about 0.1M.

18. A method of desilvering an imagewise exposed and developed color silver halide photographic element, said method comprising bleaching the photographic element with a chloride rehalogenating peroxide bleach, and subsequently fixing the photographic element with a fixer solution comprising thiosulfate anion and sodium cation;

wherein the effective Molar-minute fixing time is less than the smaller of 1.8 Molar-minutes or the quantity: 0.18 Molar-minute-$m^2$/g Aq$\times$the grams of incorporated silver per square meter of the photographic element, wherein Molar-minute fixing time is the multiplicative product of the concentration of thiosulfate in said fixer solution in units of mol/1, and the contact time of said element with said fixer solution in units of minutes, divided by the mole fraction of sodium cation relative to the total of Sodium and ammonium cations present in said fixer solution; and wherein the fixer solution is substantially free of ammonium cation and has a potassium cation concentration of less than about 0.1M.

19. The method of claim 17 wherein the quantity of silver contained in the photographic element is between about 0.7 and about 12 grams per square meter.

20. The method of claim 18 wherein the quantity of silver contained in the photographic element is between about 0.7 and about 12 grams per square meter.

21. The method of claim 17 wherein the photographic element is a negative working photographic element.

22. The method of claim 18 wherein the photographic element is a negative working photographic element.

23. The method of claim 18 wherein the photographic element is bleached in the presence of a bleach accelerator or bleach catalyst.

* * * * *